United States Patent [19]

Easton

[11] 4,196,949

[45] Apr. 8, 1980

[54] LINEAR INDEXING PROGRAMMER FOR CYCLIC OPERATIONS

[76] Inventor: Harlan J. Easton, R.R. 3, Blooming Prairie, Minn. 55917

[21] Appl. No.: 959,730

[22] Filed: Nov. 13, 1978

[51] Int. Cl.[2] ..... A47B 63/00

[52] U.S. Cl. ..... 312/183; 312/193; 312/234.5

[58] Field of Search ..... 312/197, 234.5, 183, 312/186, 191, 192, 193, 343, 201, 322

[56] References Cited

U.S. PATENT DOCUMENTS

| | | | |
|---|---|---|---|
| 786,176 | 3/1905 | Adams | 312/193 |
| 967,619 | 8/1910 | Dickey | 312/193 |
| 1,931,224 | 10/1933 | Herz | 312/234.5 |
| 2,326,277 | 8/1943 | Andersen | 312/322 |
| 2,328,019 | 8/1943 | Jones | 312/343 |
| 2,597,435 | 5/1952 | Bjoro | 312/234 |
| 2,848,292 | 8/1958 | Lewis | 312/20 |
| 3,224,824 | 12/1965 | Remke | 312/183 |
| 3,262,747 | 7/1966 | Kotzek et al. | 312/234.5 |
| 3,876,269 | 4/1975 | Fisher et al. | 312/234.1 |
| 3,994,548 | 11/1976 | Lindvall et al. | 312/197 |

*Primary Examiner*—Victor N. Sakran

*Attorney, Agent, or Firm*—Kinney, Lange, Braddock, Westman and Fairbairn

[57] ABSTRACT

A linear indexing programming for cyclic operations, for example the programming of the cycle of care and feeding of a hog operation, which has the program steps represented adjacent to one side of an open topped receptacle in which cards representing the subjects of the program are stored. The cards are separated into desired periods such as weeks within desired compartments. Each of the divider compartments holds the cards for a week of operation in a daily sequence. The divider compartments are moved from the start toward the program end daily in sequence so that the cards for the individual subjects progress through the cycle of operation and from one end of the linear movable card file to the other. The indexed or programmed functions to be performed thus align sequentially with the cards as they are moved. Specifically as shown, the daily movement may be gauged by the use of spacers which are equal to one day on the program. When the spacers are transferred from the "finish" end of the receptacle to the start end of the receptacle, the divider compartments are advanced along the program a distance equal to the day length.

10 Claims, 3 Drawing Figures

MONTH
JAN
DAY
1
SUN.
DAYS
BRED TODAY
2ND. SERVICE
PREG. TEST
VAC. FOR TGE
SPRAY
TGE BOOSTER
MOVE IN CRATES
FARROW
WEAN
OPEN SOWS
CULL SOWS
MON.
TUE.
WED.
THU.
FRI.
SAT.
0
10
20
30
40
50
60
70
80
90
100
110
120
130
140
150

FIG. 2
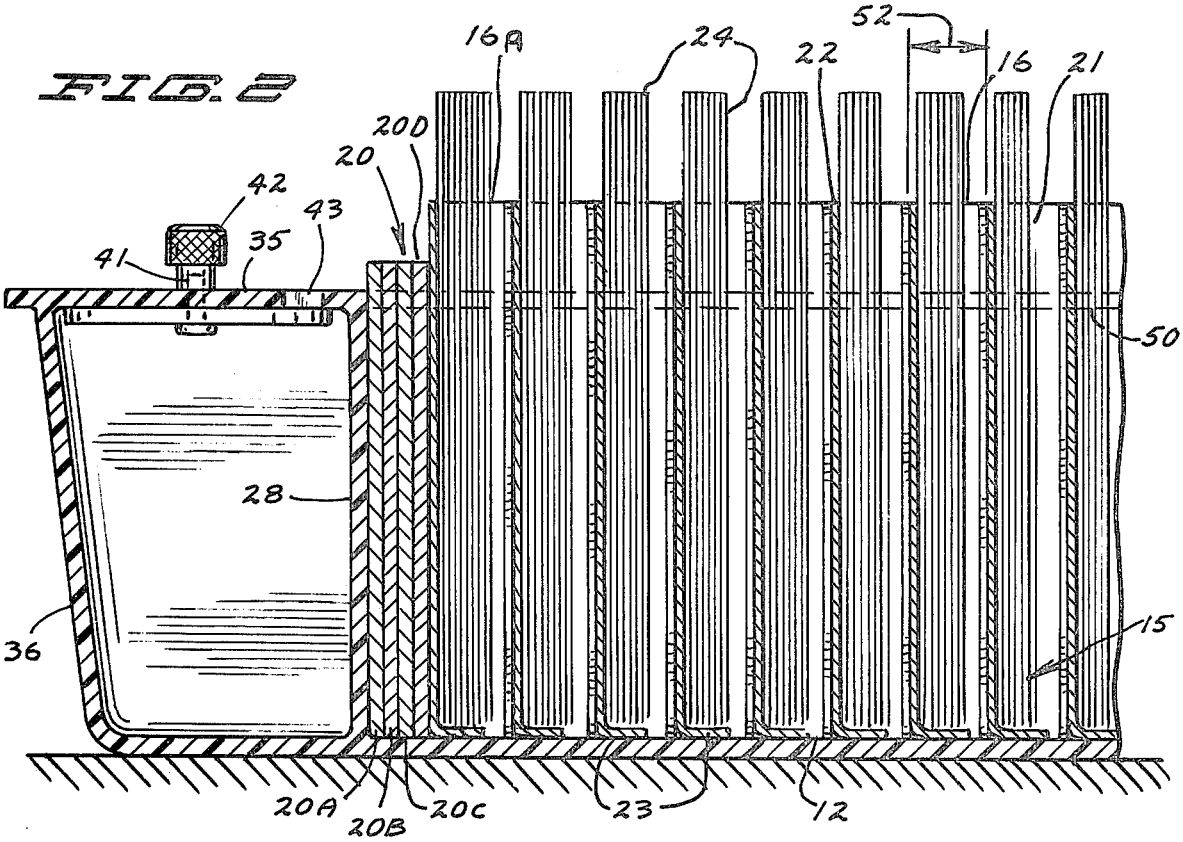
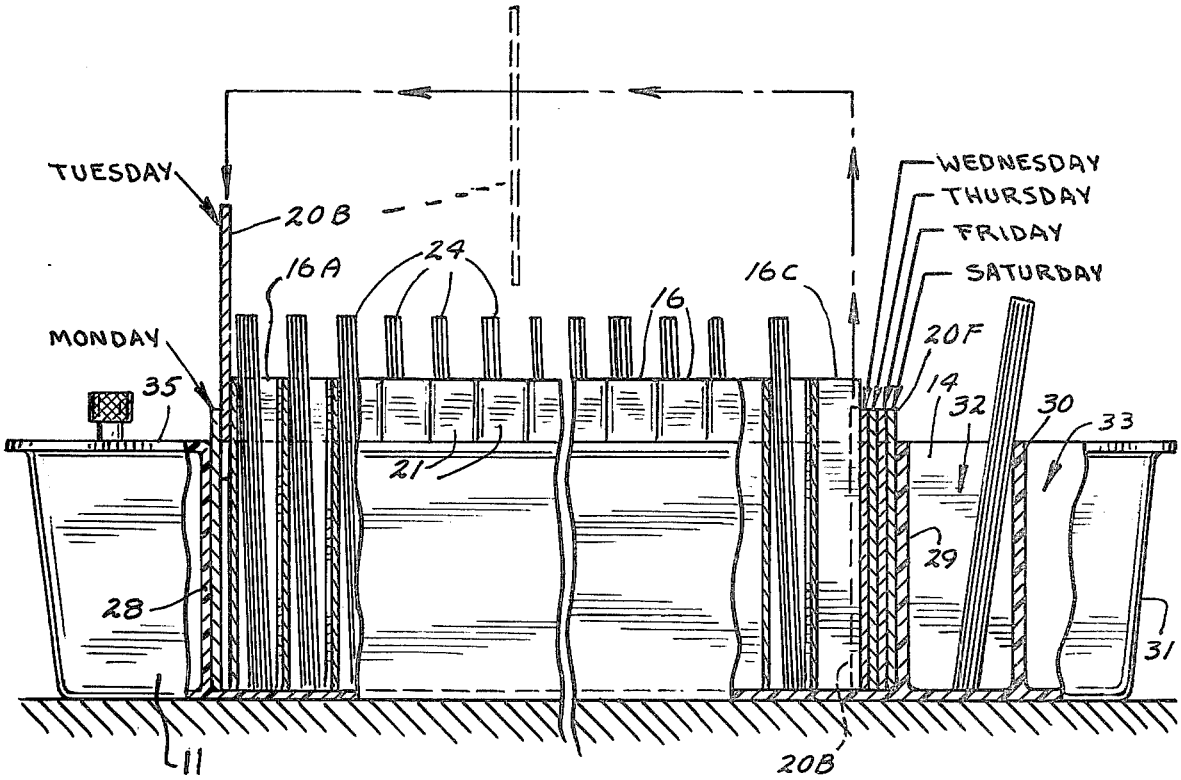
FIG. 3

LINEAR INDEXING PROGRAMMER FOR CYCLIC OPERATIONS

BACKGROUND OF THE INVENTION

1. Field of the Invention

The present invention relates to programming devices for programming a sequence of operations on a subject utilizing a linearly movable series of cards representing the subject.

2. Prior Art

Various file and display type devices have been advanced through the years, for various storage and filing activities. For example, U.S. Pat. No. 2,597,435 discloses a merchandise support that has a pocket that is removable and placed in relation to a separate support. The movable article support is mounted inside other supports that are fixed in position and are used for supporting merchandise.

U.S. Pat. No. 2,326,277 also shows a card file with index pockets that pull up, and card index trays that are removable. However, there is no teaching in this particular patent of cycling the pockets in order to perform a program.

U.S. Pat. No. 1,931,224 relates to a scheduling system that has a scale with dates of the month thereon and which scale spans a file drawer. Clips are placed laterally on the file compartment to indicate on what date particular things should be carried out. Dosage dispensers provide a type of programming, and such devices are shown in U.S. Pat. Nos. 3,744,867 and 3,876,269.

U.S. Pat. No. 2,328,019 shows a file drawer that has removable receptacles, but no program is associated with the device. There is no teaching therefore of cycling the devices at all. U.S. Pat. No. 2,848,292 shows an X-ray film holder which has hanging or suspension holders for the film that can be removed.

A rotary programmer is shown in U.S. Pat. No. 3,994,548 and a radial compartment programmer is also shown in my copending application Ser. No. 854,666, filed Nov. 25, 1977 for "Animal Production Cycle Programmer" now U.S. Pat. No. 4,143,928.

SUMMARY OF THE INVENTION

The present invention relates to a programming device for programming operations that are to be performed in sequence on subjects represented on individual cards or files. The cards or files are held in a receptacle in a file tray that has the program extending in longitudinal direction of the tray and along a lateral side thereof. The cards or files are moved in sequence from one end of the tray to adjacent the other on a daily basis to perform the program or operation shown on the programmer or schedule adjacent the card or file.

As specifically disclosed the invention comprises a unit which includes individual compartments that hold the cards for subjects representing seven individual days of program, and which compartments keep the cards divided into a small group for continued operations. The length of the linear filing device as shown is sufficient to permit an adequate number of cards for subjects started into the program for each day to be placed in each of the compartments, and also, of course, the length of the program band for each day is selected to correspond to the card space for each of the days in the compartments.

Further, as specifically shown and disclosed the programmer includes a day and month recorder to permit the recording of the dates on which the program steps are performed to insure that the program is kept up to date. Another modification shown includes the use of individual spacer blocks to represent a length of the program for one day which aids in cycling the card compartments and cards in a precise manner.

The linear program may be used as a programmer for action on other files, as well, for example, the files may be sequenced for action indicated on a program, such as for credit follow-ups which would be easily accomplished with the systems disclosed.

BRIEF DESCRIPTION OF THE DRAWINGS

FIG. 2 is a sectional view taken as on line 2—2 in FIG. 1; and

FIG. 3 is a further side elevational view of the device of FIG. 1 with parts in section and parts broken away.

DESCRIPTION OF THE PREFERRED EMBODIMENT

Figure 1:
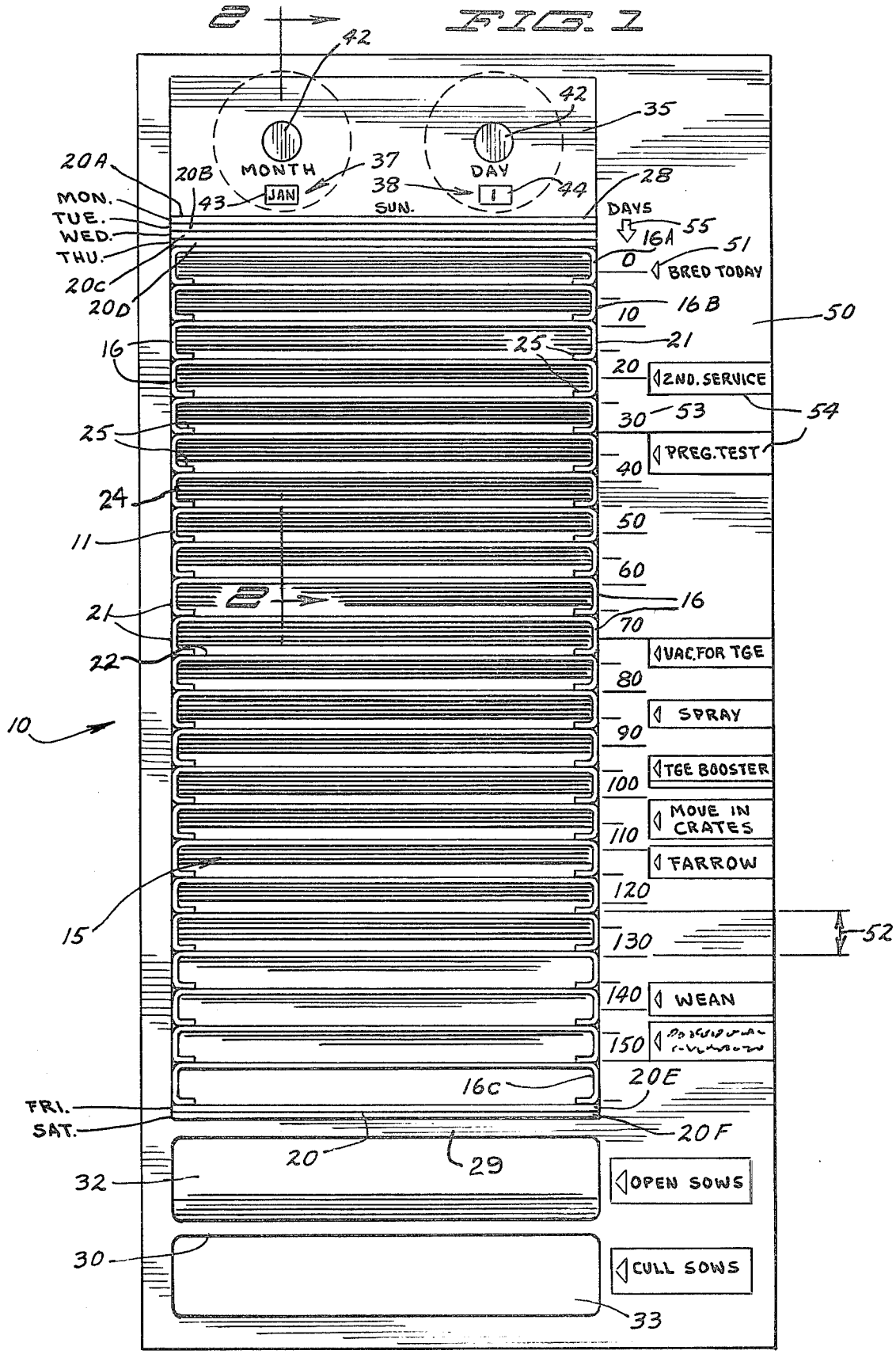
FIG. 1 is a top plan view of a linear program and recording apparatus made according to the present invention.

The programming apparatus indicated generally at 10 in FIG. 1 comprises a card file box 11 that has a bottom wall 12 (see FIG. 2), a first side wall 13 and a second side wall 14 that form an open topped receptacle indicated generally at 15 into which a number of card support compartments or dividers 16 are placed in sequence.

Receptacle 15 is of size to hold the desired number of such dividers, which in the program to be described, represent a length along the longitudinal axis of the receptacle equal to seven days of the program which would be described. A plurality of day spacers 20 which comprise flat fillers of thickness to represent a length along the longitudinal axis of receptacle 15 equal to one day.

Thus, as can be seen, the compartments 16 are placed in series contiguous to each other in sequence. The individual day spacers 20 are positioned at opposite ends of the receptacle 15. The day spacers and dividers as will be explained take up substantially all of the space in the open top receptacle, but sufficiently loose so that the compartments 16 can be removed and replaced, as can the individual day spacers.

The individual compartments 16 each have a pair of side flanges or wall panels 21 attached to a base wall panel 22, and may have, if desired, a bottom wall panel or flange 23 which is used for supporting a plurality of individual subject cards which are indicated generally at 24. In a normal hog programming operation which will be described, or in any normal programming operation utilizing the disclosed device, there will be substantially more of the individual cards 24 in each of the dividers than shown and will fill each compartment to a substantial degree.

Each card 24 represents one individual subject which is in the program. For example, the cards can represent individual sows in a hog breeding operation, which is the specific example disclosed herein. Also, it should be noted that the compartments 16 are drawn as having fairly thick walls, but this is merely for purposes of illustration and the walls would be thin. For example, 22 or 28 gauge aluminum or very thin plastic can be used. The cards 24 are ordinary receipe card stock, and they also appear to be thicker than actual. Several cards would be required to fill the spaces in the individual compartments 16.

It should also be noted that the individual compartments have inwardly turned lips 25 on the side wall panels 21 at the outer edges. The lips aid in keeping the cards 24 in each compartment separated, and aid in preventing the individual cards from tending to slip between two compartments 16 in any way and jamming the operation.

The file box side walls 13 and 14 are joined together at a program starting end of the receptacle 15 with a start cross wall 28, and adjacent the ending portion of the programming operation with an end cross wall 29. Additionally, cross walls 30 and 31 are formed to make individual storage compartments that are open topped and that are outside of the program area as will be shown, and which compartments are indicated at 32 and 33, respectively. Wall 31 is the remote end wall of the file box.

A horizontal, upwardly facing wall 35 which extends between the upper edges of walls 13 and 14 from wall 28 to a support wall 36 is provided, and the wall 35 in turn provides a space for a pair of indicators 37 and 38 indicating the month and day, respectively. As shown, each of the indicators comprise a disc 40 that is mounted below the wall 35 on a shaft 41 which in turn rotatably passes through the wall 35. A control knob 42 is attached to each shaft on the upper side of the wall. The wall 35 also is provided with apertures such as apertures 43 and 44 which permit a small portion of each disc 40 to be visible through the wall. One of the discs 40 bears a month legend as shown in aperture 43 and the other bears a day legend as shown in aperture 44, so that the selected month and day are visible to indicate to the operator of the program the last previous date of performing the program.

The side wall 14 has a side flange 50 at its upper edge, which flange 50 extends horizontally and faces upwardly as shown in FIG. 1. This flange 50 has a thickness substantially equal to that of the receptacle walls as shown in FIG. 2. The flange 50 provides a surface next adjacent one side of the receptacle 15 for laying out a particular linear program to be performed on the subjects whose cards are held within the receptacle 15. The program is indicated at 51 as disclosed in this description and extends in longitudinal direction of the receptacle 15 from the start end by wall 28 to the finish, adjacent (but as shown stopping short of) wall 29.

The program being disclosed is a hog breeding operation, as also shown in my copending application Ser. No. 854,666, filed Nov. 25, 1977, and further as shown in a carousel type operation in U.S. Pat. No. 3,994,548. The program strip 51 is separated into segments of days, and the numerals indicate the number of days since the first day. The flanges 21 of the compartments 16, the length of the compartments 16 for program purposes as indicated by the dimensions 52 in FIG. 1, is a space equal to seven days along the program strip 50. Further, the interior edge of the wall 28 is represented in FIG. 1, and the starting day zero on the program strip 51 is spaced from this edge in direction of the program an amount equal to about six days length.

The day spacers 20, of course, have a thickness (length for purposes of the program) equal to one day of program. The longitudinal length of the receptacle 15 is selected so that twenty compartments 16 and six day spacers 20, when placed in sequence, fit between walls 28 and 29.

In starting the operation, all of the day spacers 20 would be at the lower portion of the receptacle 15 adjacent to the divider wall 29. One empty compartment 16A would be up at the start end with the back wall 22 against wall 28. The lip 25 will extend about one half day width beyond the start line (shown as "0"). Then, if a sow is bred on that day, the card 24 for that sow would be placed into the empty first compartment 16A adjacent lips 25 and aligned with day zero. The lips 25 on receptacle 16A are against the base wall of the next receptacle which is indicated at 16B in FIG. 1. Assuming that the first day is a Sunday, all of the day spacers 20 would still be at the bottom of the receptacle, adjacent the wall 28.

Then all of the operations for subjects whose cards are in the program performed would be in accordance with the indicated program step. All subjects starting the program that day would have their cards placed in receptacle 16A.

On the next day Monday, the "Monday" day spacer 20A which is also shown, would be removed from adjacent wall 29 and placed into position as shown in FIG. 3 adjacent the wall 28.

This moves the receptacle 16A and the other receptacles toward the wall 29 an amount equal to one day space or length of the program. Then the cards 24 for the subjects started in the program on that Monday would be placed behind the cards placed into container 16A on the previous day. The previous days cards would thus be moved one day toward the end of the program, and because the compartments are contiguous in sequence all compartments would advance one day length, or in other words, they would be moved one day length in direction as indicated by the arrow 55. The subjects whose cards are aligned with the indicated program step will be serviced routinely.

The next day, the Tuesday spacer indicated at 20C (see FIG. 3) would be moved from dotted position shown in FIG. 3 adjacent wall 29 and as indicated by the arrows, the spacer 20B would be slipped between the Monday spacer 20A and the back wall of compartment 16A. The receptacle 16A is advanced one more day in direction as indicated by the arrow 55, and any program started on that day for individual subjects would be performed and the subject cards 24 would then the placed behind the previous two day cards in compartment 16A.

This sequencing would then continue for the Wednesday spacer 20C, and Thursday spacer 20D, and the compartments would be in the position as shown in FIG. 1. All of the compartments 16 are moved forwardly an amount equal to one day spacing each time when a day spacer is moved from the bottom of the compartment 15 toward the top and placed into position. Also each day the calendar indicator is advanced one day to keep it current.

It should be noted that each of the individual day spacers represents a thickness of equal to one day on the program strip 51. Because of cycling of days, the space between the edge of wall 28, which is indicated in FIG. 1 and program start or day zero is equal to six days space. Then, because each compartment 16 represents a length of program as indicated by the dimension 52 in FIG. 2 equal to seven days, at the end of the week, the first portion of compartment 16A would have the lips 25 positioned substantially even with the seventh day indicia along strip 51.

At the end of the week, also, therefore as can be seen in FIG. 1 because the program ends short of the wall 29 and the cards for subjects that have completed the porgram are removed, an empty compartment indicated at 16C in FIG. 1 would be adjacent to the wall 29. This empty receptacle 16C, which is shown is past the end of the program of one hundred fifty days for sow breeding, would have its lips 25 right up against the wall 29.

All of the day spacers, including the spacers 20E and 20F would be near the program start adjacent wall 28. At that point, on the next Sunday morning, the empty receptacle 16C would be removed, and all of the day spacers 20A through 20F would be also removed from the upper end adjacent wall 28. Then the day spacers would be placed in sequence adjacent wall 29 with the Saturday spacer 20F adjacent the wall 29, and the rest of them stacked in direction toward the wall 28 to take up the space that was vacated by the compartment 16C. The compartment 16C would then be placed adjacent the wall 28, and an empty compartment would be at the top of the receptacle 15 ready to start a new sequence.

The process would then continue for each day in a cycle. The original card 24 in the compartment 16A would be cycled toward the end of the program alongside the day indicia indicated at 53, and as each individual program function or step as shown at 54 was aligned with the cards in each of the compartments 16, the program step would be performed on the subjects represented by such cards.

In most operations, the number of cards for subjects on which a particular operation or service is performed each day will substantially equal the thickness of each individual day spacer. Adequate room is provided for a medium size hog operation in this particular device, and of course the file box and the compartments can be expanded in spacing if desired to accommodate the operation being contemplated.

In each of the individual compartments 16, the cards are moved as a weekly group. In most operations that require some degree of programming this is adequate and there is no need to separate out the cards into day groups. The dates on the cards will show which cards are in which day group. However, separating the cards into day groups can be done conveniently by using clips, such as paper clips, for clipping together the cards for each individual day within each of the compartments 16, or by using some other separators for the individual days.

The weekly compartments, however, do substantially reduce the need for segregating out individual cards for program performance, and thus the compartments which cycle form an important portion of the system to keep the subject cards segregated by logical groups so that the programs are not performed substantially out of sequence.

The individual compartments 16 are advanced on a daily basis, moving alongside of the program indicia 51, and as each of the cards or groups of cards adjacent to an individual program that is indicated on the indicia, this program function is performed on subjects represented by the cards. As each of the subjects is treated or otherwise the program step is performed on the subject, the completion can be noted on the individual card. The cards which are completed can be marked with a different type of clip so they are segregated as well.

Further, because the card 24 protrudes above the level of the compartments 16 a substantial distance, the cards are easily segregated into groups with hogs, each individual pen of hogs may form a group of cards. In this way, the operator knows in which pen the animals on which a service is to be performed are located. The markings can merely be a tag that indicates a pen number such as "pen No. 2" clipped over the cards for the animals in that pen.

Normally, to simplify things a particular pen of animals could be started out on a particular day so that the animals in an individual pen would be all serviced on the same day for each of the program steps. The positioning of the flange 50 and program strip adjacent to one of the side walls of the receptacle 15 and thus close to the individual cards, makes the program indicators align easily. The day and date reminder wheels indicate when the last day of performing a program was, so that if in fact a farmer or operator does not perform the programs each day and every day, he will know how many day's cards have to be reviewed, and also how many daily spacers have to be placed into position to bring the program into the proper orientation.

It should be noted, again, that the program sequence should be slightly shorter than the total length of the receptacle 15 for the compartments 16, because the completion of the program will leave a portion of each of the holders without any cards on which the program is to be performed as it reaches the end of the cycle. Thus, the difference between one hundred fifty day indication on the program step shown and the wall 29 has to be at least equal to the dimension 52 of the card compartments.

The receptacles 30 and 31 are used for cards of subjects on which the program is not in force, and thus the cards for "open sows" for example, that is, sows that have not be bred, can be stored in compartment 32. The operator can easily see how many animals or subjects are not entered into the program and take appropriate steps to get them into the program. Likewise, the compartment 33 can be used for storing cards on additional subjects or animals that are part of the operation, but not necessarily included in the program or animals that are to be sold.

The linear indexer, therefore, provides a relatively low cost molded housing that merely has a receptacle of sufficient width to receive the desired receptacles for holding individual subject cards, and of an appropriate length to receive a number of movable compartments so that they do not shift substantially in the length direction once they are all in place, and which compartment can be sequenced from bottom to top, with the empty compartment being removed and replaced near the start of the program order. The addition of the individual day spacers is a desirable feature, but is not absolutely necessary for appropriate programming, or for programming which does not require precise daily movement the compartments can be advanced without using the day spacers. The space shown for day spacers would be taken by an additional compartment 16. The compartments would be shifted once a week. The cards would be placed in the compartment 16A for one week, and at the end of the week an empty compartment would be moved from adjacent wall 29 to adjacent wall 28 to advance wall 28 to advance all compartments one week's length.

The compartments 16 together form a compartment set that is sized to fit the receptacle 15 with a space substantially of length equal to at least one compartment beyond the end of the program strip for either the day spacers or an empty compartment. When the day spacers 20 are used they add up in length to one compartment. It should also be noted that the indicia showing the desired functions or program steps to be performed may be labels that adhere to flange 50, or can be small cards held in blocks that are placed on the flange or the program steps could be placed on labels that are clipped to the flange.

The cards 24 may be placed in the receptacle 15 without the compartments 16, or for example, the compartments could be file jackets that are sequenced. Hanging file folders also could be used. The compartments 16 may also be reversed from the position shown with legs 25 positioned toward wall 28.

The cards are subject indicia members that indicate a particular subject. An entire file folder also could comprise subject indica members that would be cycled past a program or remainders or the like.

What is claimed is:

1. A programming device comprising wall means defining an open top receptacle having a longitudinal length and a transverse width, a plurality of removable subject indicia cards of size to extend transversely across said receptacle and being movable along said longitudinal length, said subject indicia cards each being removable from said receptacle adjacent one end of said receptacle after being previously sequentially placed adjacent a starting end of said receptacle and moved to the second end in increments corresponding to preselected portions of the longitudinal length of the receptacle, and indicia means adjacent one side of the receptacle and aligning with and being adjacent one edge of the subject indicia cards as the subject indicia cards are sequentially moved to the second end of said receptacle, said indicia means indicating actions to be taken relative to the subjects represented on the subject indicia cards aligning with the indicia means, said indicia means being spaced a desired number of the preselected portions of the longitudinal length.

2. The programming device of claim 1 wherein said increments of movement of said subject indicia members represent increments of time.

3. The programming device of claim 2 and a plurality of compartments of size to removably fit within said receptacle to form a compartment set, said compartments each holding a plurality of said cards and each compartment having a length in longitudinal direction of said receptacle equal to a desired number of time increments.

4. The programming device of claim 3 wherein the total length of said compartment set and receptacle is selected to be longer than the indicia means to permit the compartment set to be moved as a group for each time increment and cycled past all of the indicia means.

5. The programming device of claim 3 wherein said increments of time represent days in a program sequence, and said indicia means adjacent one side of said receptacle has indicia indicating days elapsed from the start of a program, and a manually advanceable calendar means mounted on the programming device adjustable to new individual dates upon completing the program function for each day.

6. The combination as specified in claim 3 wherein said compartments comprise open top compartment receptacles having at least lateral side walls, and a base wall transverse to the longitudinal direction of said receptacle, said side walls representing the length of said compartment in said longitudinal direction.

7. The combination as specified in claim 4 and a plurality of filler members of size to removably fit transversely across said receptacle, and each having a length in direction of the longitudinal length of said receptacle suubstantially equal to the longitudinal length of the selected time increment.

8. The method of utilizing a file card receiving receptacle for programming comprising the steps of providing program indicia adjacent one side of said receptacle and having a program sequence extending from a starting end to adjacent a finish end along the longitudinal length of said receptacle, placing a plurality of compartments within said receptacle, the length of each compartment in direction along the longitudinal length of said receptacle representing a desired number of days of program, placing individual cards each representing program subjects in said compartments at the starting end of said program, and sequentially moving each compartment each desired period for said program toward the finish end, said receptacle having sufficient length to permit all of the compartments to be moved as a set for the increment of time represented by the length of one compartment, and having a length equal to at least one compartment length at the end of the program, and removing the cards from each compartment as they pass the finish of the program, removing a compartment next adjacent the finish end and placing it at the starting end of the compartment set after completion of the number of days represented by a compartment length to thereby continuously cycle the compartments within the receptacle on a time basis.

9. The method of claim 8 including the further step of providing individual spacers having a length in longitudinal direction of said receptacle equaling a desired number of days of program, one less than the days represented by the length of said compartments, and sequentially cycling spacers individually from a storage space between the end of the program and the end wall of the receptacle at the finish end up to a space between the end wall of the receptacle at the starting end of the program and the first compartment of the compartment set during each of the periods of time represented by the spacers, so that each time a spacer is removed from adjacent the finish end of the program and placed adjacent the starting end of the program the compartments are moved a space equal to one day of time on the program strip, and at the end of a desired number of days representing one day less than the days represented by the length of the compartments, placing all of the spacers in the receptacle adjacent the finish end after removing the empty compartment from the finish end.

10. A program indicator device comprising a plurality of upright walls forming a rectilinear open top receptacle having a longitudinal length extending between first and second ends and a transverse width, a plurality of generally planar subject indicia cards representing subjects to which action is to be taken in sequence, said subject indicia cards being of size to fit within said receptacle extending across said receptacle generally perpendicular to the direction of the longitudinal length of the receptacle, said subject indicia cards being sequentially placed in said receptacle adjacent the first end thereof and sequentially movable along said longitudinal length toward the second end thereof as other subject indicia cards are removed from the receptacle adjacent said second end, a flange mounted on and perpendicular to one of the upright walls adjacent one side of the receptacle and extending between the first and second ends and supporting indicia dividing said longitudinal length into time segments commencing at said one end and extending toward the second end of said receptacle, means on the flange indicating desired functions to be performed on subjects represented by the subject indicia cards at desired time segments after a start of a program, said subject indicia cards aligning sequentially with the indicia on said support flange, and a plurality of compartments slidably fitted within said receptacle and extending transversely between the first and second walls, each compartment being selected to have a length in longitudinal direction of said receptacle equal to a desired number of time segments of said indicia, each compartment holding a desired number of subject indicia cards and being replaceable from the second end of the receptacle to the first end of the receptacle when a program has been completed so that the compartment can receive new cards adjacent a first end of said receptacle.

* * * * *